US009033752B2

(12) United States Patent
Takase

(10) Patent No.: US 9,033,752 B2
(45) Date of Patent: May 19, 2015

(54) SUSPENSION DEVICE FOR OUTBOARD MOTOR, VESSEL PROPULSION APPARATUS, AND VESSEL

(71) Applicant: Yamaha Hatsudoki Kabushiki Kaisha, Iwata-shi, Shizuoka (JP)

(72) Inventor: Hiroaki Takase, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 19 days.

(21) Appl. No.: 14/153,530

(22) Filed: Jan. 13, 2014

(65) Prior Publication Data

US 2014/0199898 A1 Jul. 17, 2014

(30) Foreign Application Priority Data

Jan. 15, 2013 (JP) ..... 2013-004701

(51) Int. Cl.
*B63H 20/02* (2006.01)
*B63H 20/10* (2006.01)

(52) U.S. Cl.
CPC ..... *B63H 20/02* (2013.01); *B63H 20/10* (2013.01)

(58) Field of Classification Search
CPC ..... B63H 20/02; B63H 20/10; C23F 13/06; C23F 13/12; C23F 13/14; C23F 13/20
USPC ..... 440/61 D, 61 F, 61 G, 61 T, 63; 204/196.37
See application file for complete search history.

(56) References Cited

U.S. PATENT DOCUMENTS 6,071,157 A * 6/2000 Yoshino et al. ..... 440/61 R
7,351,125 B2 * 4/2008 Ide et al. ..... 440/53
8,377,266 B2 2/2013 Kagawa

* cited by examiner

*Primary Examiner* — Lars A Olson
(74) *Attorney, Agent, or Firm* — Keating & Bennett, LLP

(57) ABSTRACT

A swivel bracket is coupled via a horizontal bracket to a clamp bracket to be mounted on a vessel. A trim mechanism adjusts a trim angle of an outboard motor by rotating the swivel bracket about the horizontal shaft. The trim mechanism includes a trim cylinder coupled to the clamp bracket and a trim rod that is projectable and retractable from the trim cylinder. A thrust receiver is attached to the swivel bracket. The thrust receiver receives a load from the trim rod. The thrust receiver is grounded. The thrust receiver includes a conducting portion in contact with the trim rod.

20 Claims, 8 Drawing Sheets

SUSPENSION DEVICE FOR OUTBOARD MOTOR, VESSEL PROPULSION APPARATUS, AND VESSEL

BACKGROUND OF THE INVENTION

1. Field of the Invention

The present invention relates to a suspension device for an outboard motor, a vessel propulsion apparatus including the suspension device, and a vessel to be propelled by the vessel propulsion apparatus. In particular, the present invention relates to a suspension device for an outboard motor that prevents electrolytic corrosion of a trim rod that is extendable from a trim cylinder included in a trim angle adjusting device of an outboard motor, a vessel propulsion apparatus including the suspension device, and a vessel including the vessel propulsion apparatus.

2. Description of the Related Art

A suspension device to attach an outboard motor on a hull includes a clamp bracket, a swivel bracket tiltably coupled to the clamp bracket, and a tilt cylinder device interposed between both brackets.

The clamp bracket removably fixes the suspension device to a stern of a vessel. An outboard motor is attached to the swivel bracket. The tilt cylinder device includes a tilt cylinder to perform a tilt operation and a trim cylinder to perform a trim operation.

The tilt cylinder tilts the outboard motor within a tilt range. The trim cylinder tilts the outboard motor within a trim range smaller in tilt angle than the tilt range. The tilt cylinder is used, for example, when lifting the outboard motor above a water surface during a stop or the like of the vessel. On the other hand, the trim cylinder is used, for example, when adjusting the running posture of the vessel during running of the vessel.

The trim cylinder of the tilt cylinder device includes a trim rod that is projectable and retractable from a cylinder tube of the trim cylinder. For the trim rod, which receives a thrust of the outboard motor, a strength that can withstand the thrust of the outboard motor is thus required. Therefore, the trim rod is made of, for example, an iron-based material that is excellent in strength, such as a stainless steel.

The trim rod is made of an iron-based material, whereas a cylinder block of the tilt cylinder device is made of an aluminum alloy. Aluminum has the highest ionization tendency among members of the tilt cylinder device. Thus, in order to protect the cylinder block from electrolytic corrosion, a sacrificial anode member (sacrificial electrode) called an anode (hereinafter, referred to as an anode) containing a metal such as zinc that is larger in ionization tendency than the main material such as iron and aluminum alloy is attached to the clamp bracket or the like, and the cylinder block is connected to the anode via a ground wire.

However, the trim rod is in an electrically insulated state from surrounding structural members such as a cylinder tube and a trim rod guide of the trim cylinder. Therefore, even when the cylinder tube or trim rod guide of the trim cylinder is connected to the anode by a ground wire, a sacrificial corrosion preventing effect by the anode does not reach the trim rod. Thus, when the trim rod is exposed to seawater or the like, a potential difference occurs between the trim rod and structural members around the trim rod and thus a local battery may be created. The trim rod may therefore be electrolytically corroded.

The potential difference is not only caused by a difference in the type of metal material between the trim rod and the surrounding structural members, but occurs also due to a difference in the type of metal material of the trim rod. In either case, the trim rod electrolytically corrodes due to a metal material having a large ionization tendency being ionized and eluted into seawater.

U.S. Pat. No. 8,377,266 discloses a structure in which a piston fixed to a trim rod is electrically connected to a rod guide when the rod is projected at the maximum, in order to prevent electrolytic corrosion of the trim rod. According to the structure, the trim rod is, at its maximum projection, electrically connected to the cylinder block via the piston, rod guide, and trim cylinder. It describes that the trim rod is accordingly grounded to prevent electrolytic corrosion of the trim rod.

However, during use of the outboard motor, there is little time that the trim rod is in a state of maximum projection and, thus, the trim rod is most often in a state of not being electrically connected with the rod guide. Thus, with the structure above, the effect to prevent electrolytic corrosion of the trim rod cannot be expected during use of the outboard motor. In particular, when the operating time of the outboard motor is long, the trim rod may be electrolytically corroded. As above, depending on the use of the outboard motor, the time that the trim rod is in a state other than the state of maximum projection, that is, the time that the trim rod is in a non-grounded state is longer than the time that the trim rod is in a state of maximum projection. Thus, with the above structure, the effect to prevent electrolytic corrosion of the trim rod is not always expected.

SUMMARY OF THE INVENTION

Preferred embodiments of the present invention provide a suspension device for an outboard motor that effectively prevents electrolytic corrosion of the trim rod that is structurally difficult to be grounded because it moves with respect to the cylinder, without greatly changing the structure of the suspension device.

A preferred embodiment of the present invention provides a suspension device, which tiltably suspends an outboard motor on a hull, for an outboard motor. The suspension device for the outboard motor includes a clamp bracket to be mounted on a vessel and a swivel bracket coupled to the clamp bracket via a horizontal shaft. Further, the suspension device includes a trim mechanism that adjusts a trim angle of the outboard motor by rotating the swivel bracket about the horizontal shaft such that an attaching angle of the swivel bracket with respect to the clamp bracket changes. The trim mechanism includes a trim cylinder coupled to the clamp bracket and a trim rod extending in a manner projectable and retractable from the trim cylinder. Further, the suspension device includes a thrust receiver attached to the swivel bracket to receive a load from the trim rod. The thrust receiver is grounded. The thrust receiver includes a conducting portion that contacts the trim rod. The thrust receiver is arranged to ground the trim rod by contact of the conducting portion with the trim rod.

The clamp bracket and the swivel bracket are structural members of the suspension device. The outboard motor is attached to the swivel bracket. An anode (sacrificial anode member) is attached to at least one of the clamp bracket, the swivel bracket, and the outboard motor. In the suspension device, "thrust receiver . . . grounded" means that the thrust receiver is electrically connected to at least one of the clamp bracket, the swivel bracket, the outboard motor, and the anode (sacrificial anode member).

In the suspension device, the trim rod and the thrust receiver are preferably made of conductive materials.

In the suspension device, a ground wire is preferably connected to the thrust receiver. Moreover, the ground wire may be connected to any of the clamp bracket, the swivel bracket, and the outboard motor. Preferably, the ground wire is connected to an anode (sacrificial anode member) attached to any of the clamp bracket, the swivel bracket, and the outboard motor.

Preferably, the swivel bracket includes a through-hole into which a trunk portion of the thrust receiver is fitted. The thrust receiver may be fixed to the swivel bracket with the trunk portion of the thrust receiver fitted into the through-hole.

The thrust receiver may include a head portion that contacts the trim rod and a trunk portion coupled to the head portion of the thrust receiver. In this case, a conducting portion is included in the head portion of the thrust receiver.

The thrust receiver may include an insulating layer provided on a portion of the thrust receiver excluding the conducting portion. The insulating layer may be provided on at least one of a portion of the thrust receiver that the swivel bracket contacts and a portion of the swivel bracket that the thrust receiver contacts.

The thrust receiver may include an insulating layer provided on a portion of the thrust receiver that contacts the swivel bracket so that a current does not flow between the thrust receiver and swivel bracket.

The thrust receiver may be fixed to the swivel bracket by fitting the trunk portion of the thrust receiver into a through-hole provided in the swivel bracket and screwing a nut onto a screw portion of the trunk portion. In this case, the thrust receiver may be grounded by connecting a ground wire to the nut. Or the thrust receiver may be grounded by disposing a conductive washer between the swivel bracket and the nut and connecting a ground wire to the washer.

The suspension device may further include a tilt mechanism that adjusts a trim angle of the outboard motor by rotating the swivel bracket about the horizontal shaft so that an attaching tilt angle of the swivel bracket with respect to the clamp bracket changes.

The trim mechanism may include two trim cylinders and two trim rods extending from the respective trim cylinders. The suspension device may include two thrust receivers that contact the two trim rods, respectively.

Further, the suspension device may include the tilt mechanism disposed between two trim cylinders.

Another preferred embodiment of the present invention provides a vessel propulsion apparatus including an outboard motor and any of the suspension devices according to any of the preferred embodiments described above.

Still another preferred embodiment of the present invention provides a vessel including the vessel propulsion apparatus according to a preferred embodiment of the present invention described above.

A suspension device for an outboard motor according to a preferred embodiment of the present invention includes a clamp bracket to be mounted on a vessel and a swivel bracket coupled to the clamp bracket via a horizontal shaft. Further, the suspension device includes a trim mechanism. The trim mechanism includes a trim cylinder coupled to the clamp bracket and a trim rod extending so as to be projectable and retractable from the trim cylinder. The trim mechanism adjusts a trim angle of the outboard motor by rotating the swivel bracket about the horizontal shaft so that an attaching angle of the swivel bracket with respect to the clamp bracket changes. The suspension device includes a thrust receiver attached to the swivel bracket to receive a load from the trim rod. The thrust receiver is grounded. The thrust receiver includes a conducting portion. The conducting portion is provided at a portion of the thrust receiver with which the trim rod comes into contact. The conducting portion makes the trim rod electrically conductive.

Thus, during use of the outboard motor, the trim rod is maintained in a state of being in electrical contact with the thrust receiver as a result of receiving a load from the thrust receiver due to a thrust of the outboard motor. Because the thrust receiver is grounded, the trim rod is in a grounded state via the thrust receiver. Because the trim rod is thus reliably grounded during use of the outboard motor, which is a situation where the trim rod is most likely to be electrolytically corroded, electrolytic corrosion of the trim rod is effectively prevented. Moreover, electrolytic corrosion of the trim rod is effectively prevented without greatly changing the conventional structure.

When the trim rod and the thrust receiver are made of conductive materials, electrical conduction by both is reliably maintained. Moreover, even if there is an oxide film provided on the outer surface of the conducting portion of the thrust receiver, because the tip portion of the trim rod is strongly pressed against the thrust receiver by a thrust of the outboard motor and rubbed against the thrust receiver by the thrust of the outboard motor in the course of using the outboard motor, electrical conduction is secured. Thus, maintenance of the outer surface of the conducting portion of the thrust receiver is unnecessary.

When a ground wire is connected to the thrust receiver, the trim rod is grounded reliably. However, the thrust receiver is not necessarily grounded via a ground wire. For example, the thrust receiver may be grounded to the swivel bracket or the like without a ground wire by being coupled and fixed to the swivel bracket or the like in an electrical contact state.

Moreover, when a ground wire is connected to an anode (sacrificial anode member) attached to any of the clamp bracket, the swivel bracket, and the outboard motor, the trim rod is reliably grounded. Thus, the trim rod is reliably prevented from electrolytic corrosion. However, the ground wire is not necessarily one that directly connects the thrust receiver to the anode. For example, the ground wire may connect the thrust receiver to the swivel bracket or the like. Also in this case, the thrust receiver is connected to the anode via the swivel bracket or the like, and eventually, the trim rod is grounded.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
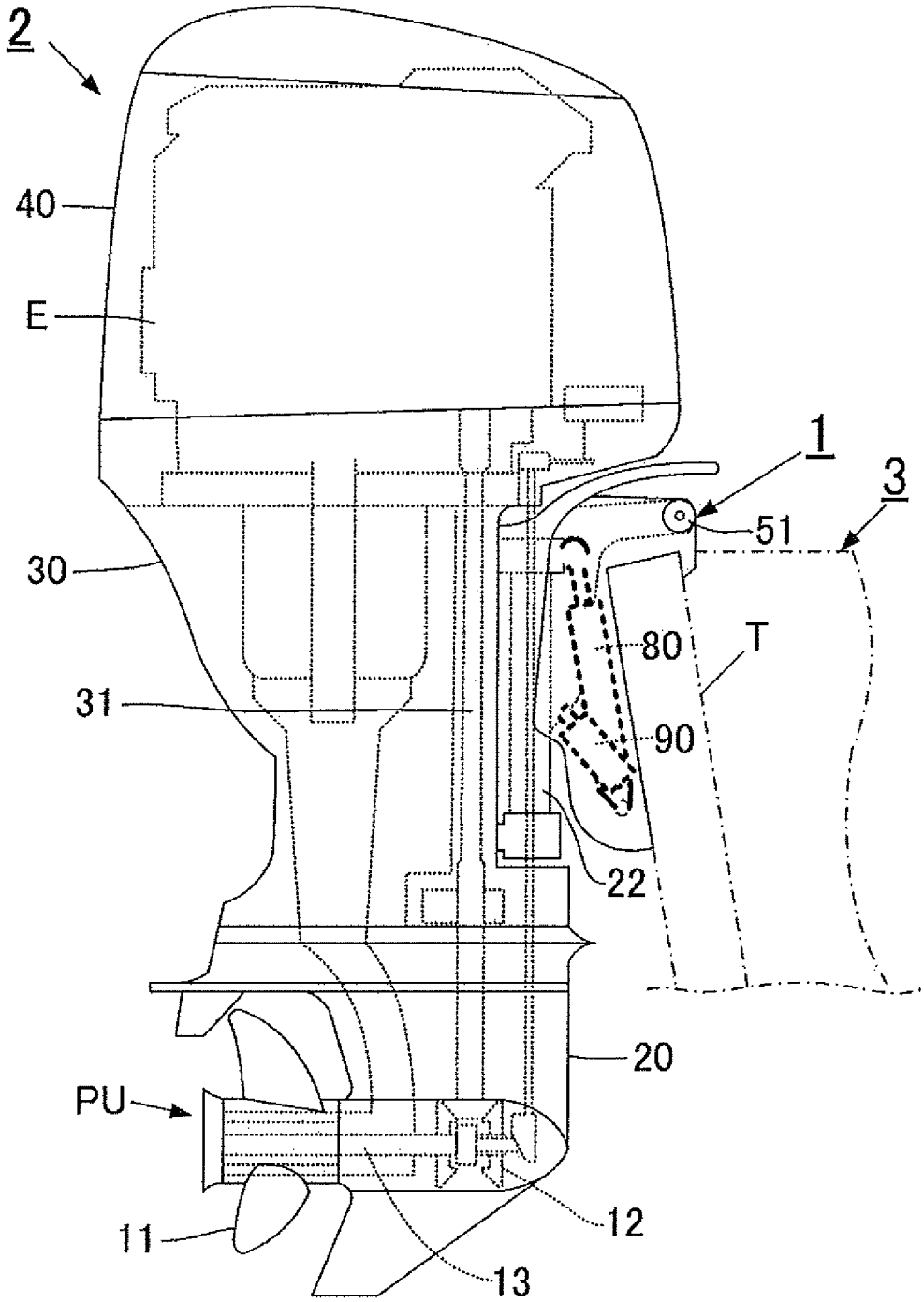
FIG. 1 is a side view showing a state in which an outboard motor is attached to a stern of a vessel using a suspension device for an outboard motor according to a preferred embodiment of the present invention.

As shown in FIG. 1, a vessel includes a hull that floats on a water surface and a vessel propulsion apparatus that propels the hull. The vessel propulsion apparatus includes a suspension device 1 that is attachable to a rear portion (stern) of the hull and an outboard motor 2 that is attached to the hull via the suspension device 1.

As shown in FIG. 1, the outboard motor 2 includes a lower casing 20 disposed in a lower portion of the outboard motor 2. A propeller unit PU is held by the lower casing 20. The propeller unit PU includes a cylindrical propeller member including a plurality of blades 11 and a propeller damper D (refer to FIG. 9) housed in the propeller member. A forward/reverse switching mechanism 12 and a propeller shaft 13 are provided in the lower casing 20. An upper casing 30 is disposed on the lower casing 20, and fixed to the lower casing 20. The upper casing 30 houses a drive shaft 31 in a vertical orientation. An engine E is installed on the upper casing 30. The engine E is covered with a cowling 40 defining and serving as an engine cover.

A rotating force of the engine E is transmitted to the forward/reverse switching mechanism 12 in the lower casing 20 via the drive shaft 31 in the upper casing 30. The drive force transmitted to the forward/reverse switching mechanism 12 is transmitted to the blades 11 via the propeller shaft 13. The rotating direction of the propeller shaft 13, that is, the rotating direction of the blades 11 is switched by the forward/reverse switching mechanism 12.

Figure 2:
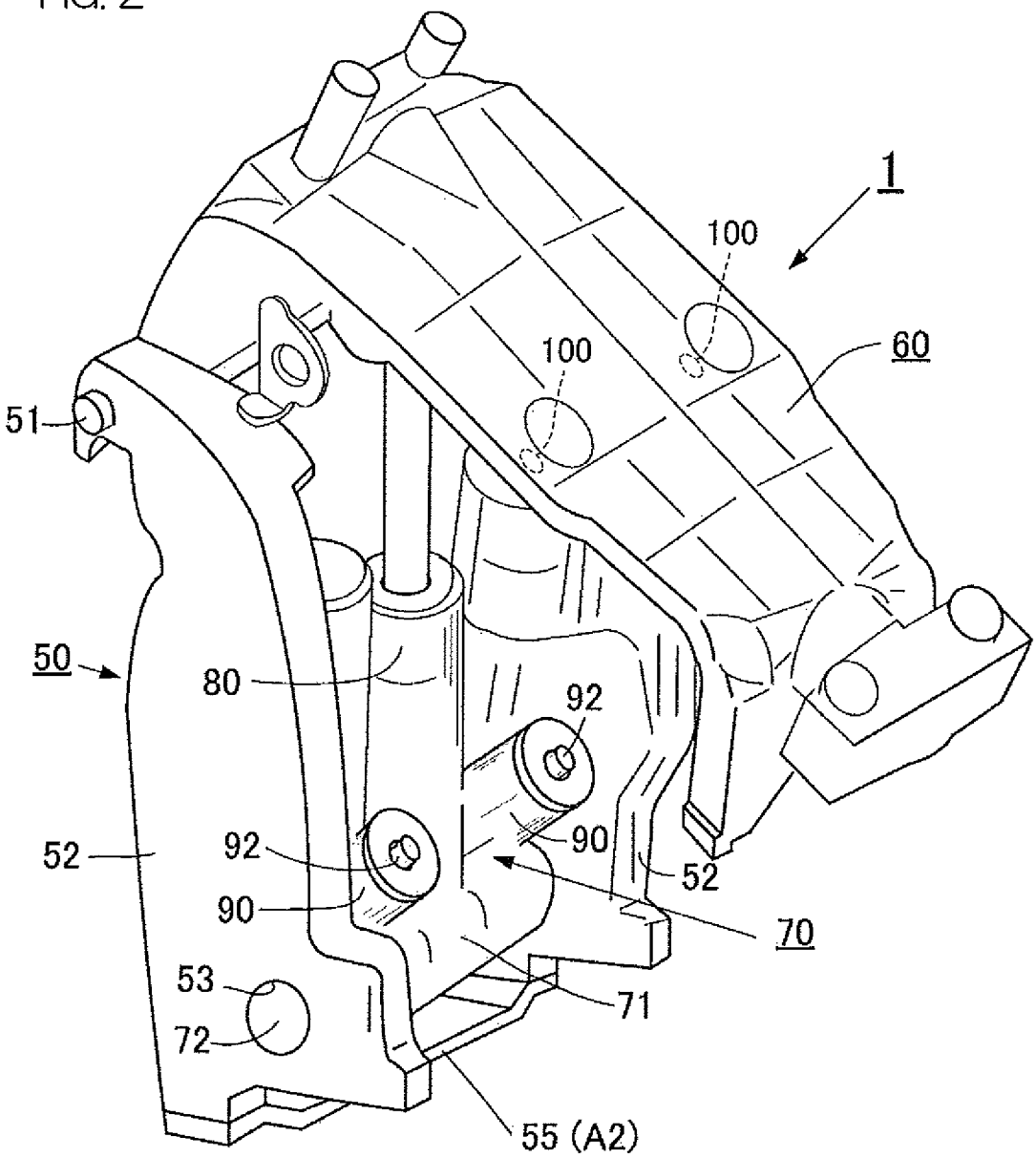
FIG. 2 is an overall perspective view of the suspension device mentioned above.

The suspension device 1, as shown in FIG. 1 and FIG. 2, includes a clamp bracket 50 that is removably fixed to a stern T and a swivel bracket 60 coupled to the clamp bracket 50 to be rotatable about a tilt shaft 51 defining and serving as a horizontal rotating shaft (horizontal shaft). The suspension device 1 further includes a tilt cylinder device 70 disposed between the clamp bracket 50 and the swivel bracket 60. An attaching angle of the swivel bracket 60 with respect to the clamp bracket 50 is changed by supply and discharge of a hydraulic oil to and from the tilt cylinder device 70 being controlled. As a result, an attaching angle (angle about the tilt shaft 51) of the outboard motor 2 attached to the swivel bracket 60 is changed.

The clamp bracket 50 includes a pair of left and right side-portion bracket members 52 and 52 disposed at a predetermined interval and a bottom-portion coupling member 55 coupled to bottom portions of both side-portion bracket members 52 and 52. The bottom-portion coupling member 55 is an example of an anode (sacrificial anode member) A2.

The tilt shaft 51 defining and serving as the horizontal rotating shaft (horizontal shaft) is provided in upper end portions of the pair of left and right side-portion bracket members 52 and 52 of the clamp bracket 50. A right side portion and a left side portion of an upper end portion of the swivel bracket 60 are coupled to the tilt shaft 51 in a state of the swivel bracket 60 being rotatable with respect to the clamp bracket 50. Thus, the swivel bracket 60 rotates about the tilt shaft 51 within a range of a predetermined tilt angle. Accordingly, the attaching angle of the swivel bracket 60 is changed.

Figure 3:
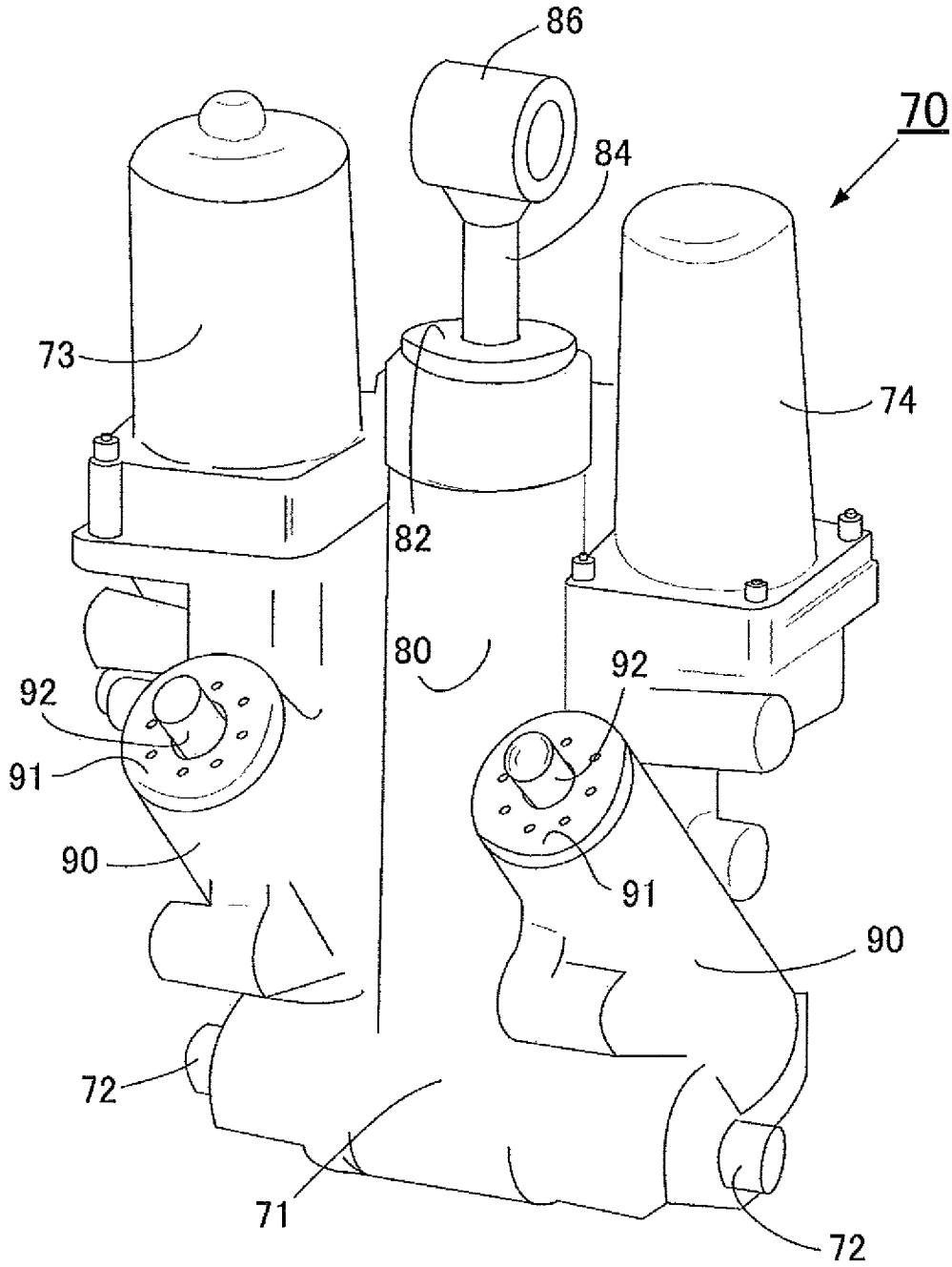
FIG. 3 is a perspective view showing a tilt cylinder device of the suspension device mentioned above.

The tilt cylinder device 70, as shown in FIG. 2 and FIG. 3, includes a tilt cylinder 80 disposed in the center of a cylinder block 71 and trim cylinders 90 and 90 disposed on left and right sides of the tilt cylinder 80, respectively.

As shown in FIG. 3, the two trim cylinders 90 are disposed at an interval in the left-right direction. The tilt cylinder 80 is disposed between the two trim cylinders 90 in the left-right direction. Each of the cylinders 80, 90, and 90 includes a cylinder tube that retains a hydraulic oil, a piston that partitions the interior of the cylinder tube into two oil chambers (upper chamber and lower chamber), and a rod that extends axially from the piston to the exterior of the cylinder tube through an end portion of the cylinder tube. As shown in FIG. 2, the suspension device 1 includes two thrust receivers 100 corresponding to the two trim rods 92, respectively.

The cylinder block 71 includes attaching shafts 72 and 72 at both left and right sides of a lower end portion of the cylinder block 71. The attaching shafts 72 and 72 are inserted in attaching holes 53 and 53 provided in the left and right side-portion bracket members 52 and 52 of the clamp bracket 50. Accordingly, the cylinder block 71 is coupled to the clamp bracket 50.

The tilt cylinder 80 includes a rod guide 82 attached to an upper-end opening portion of the tilt cylinder 80. The tilt rod 84 is slidably inserted in the rod guide 82. The piston (not shown) of the tilt cylinder 80 is fixed to the lower end of the tilt rod 84. The tilt rod 84 includes an attaching portion 86 provided at the upper end of the tilt rod 84. The attaching portion 86 of the tilt rod 84 is coupled to the swivel bracket 60.

Figure 4:
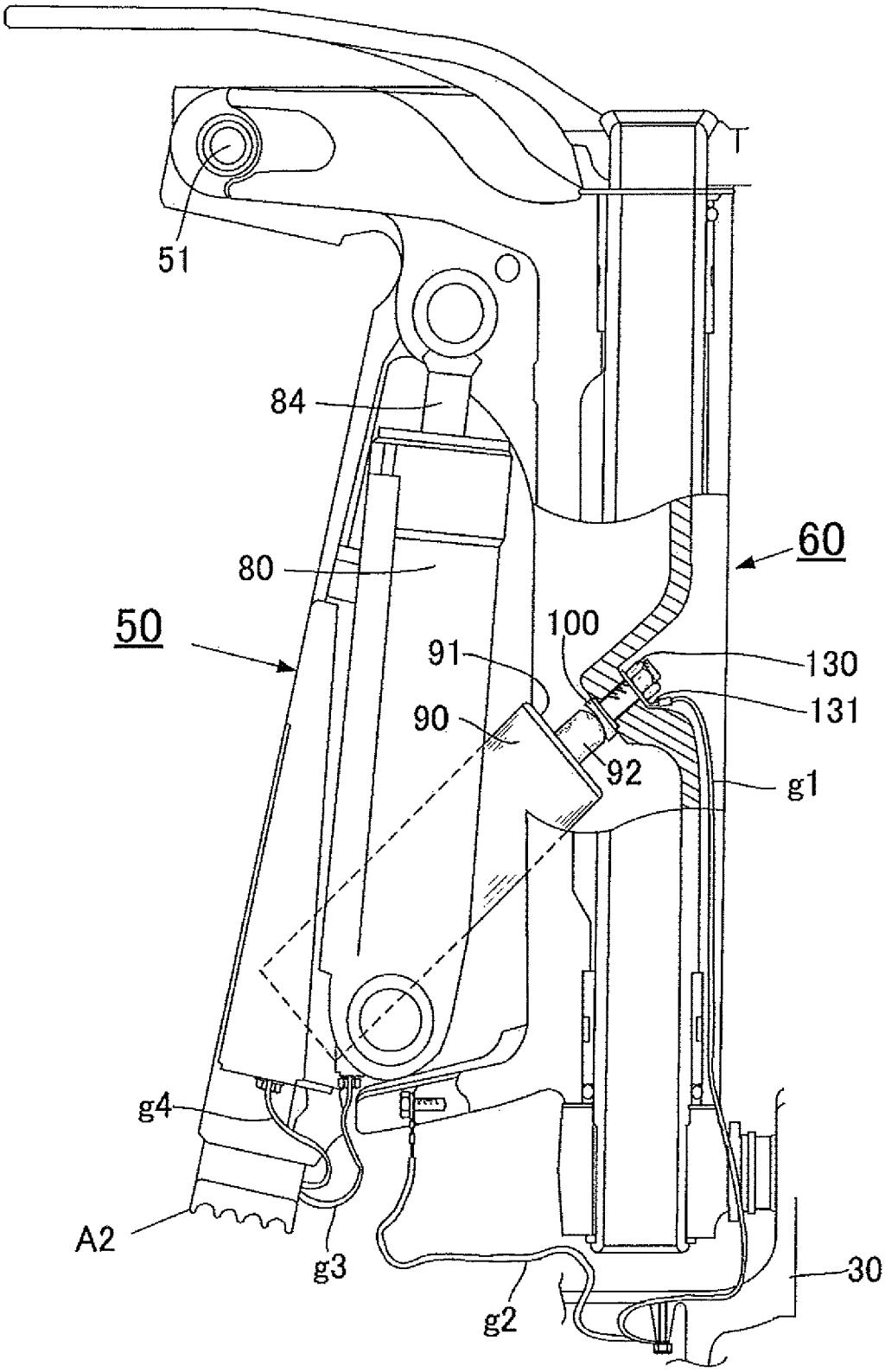
FIG. 4 is a partial sectional view showing the suspension device mentioned above.
Figure 5:
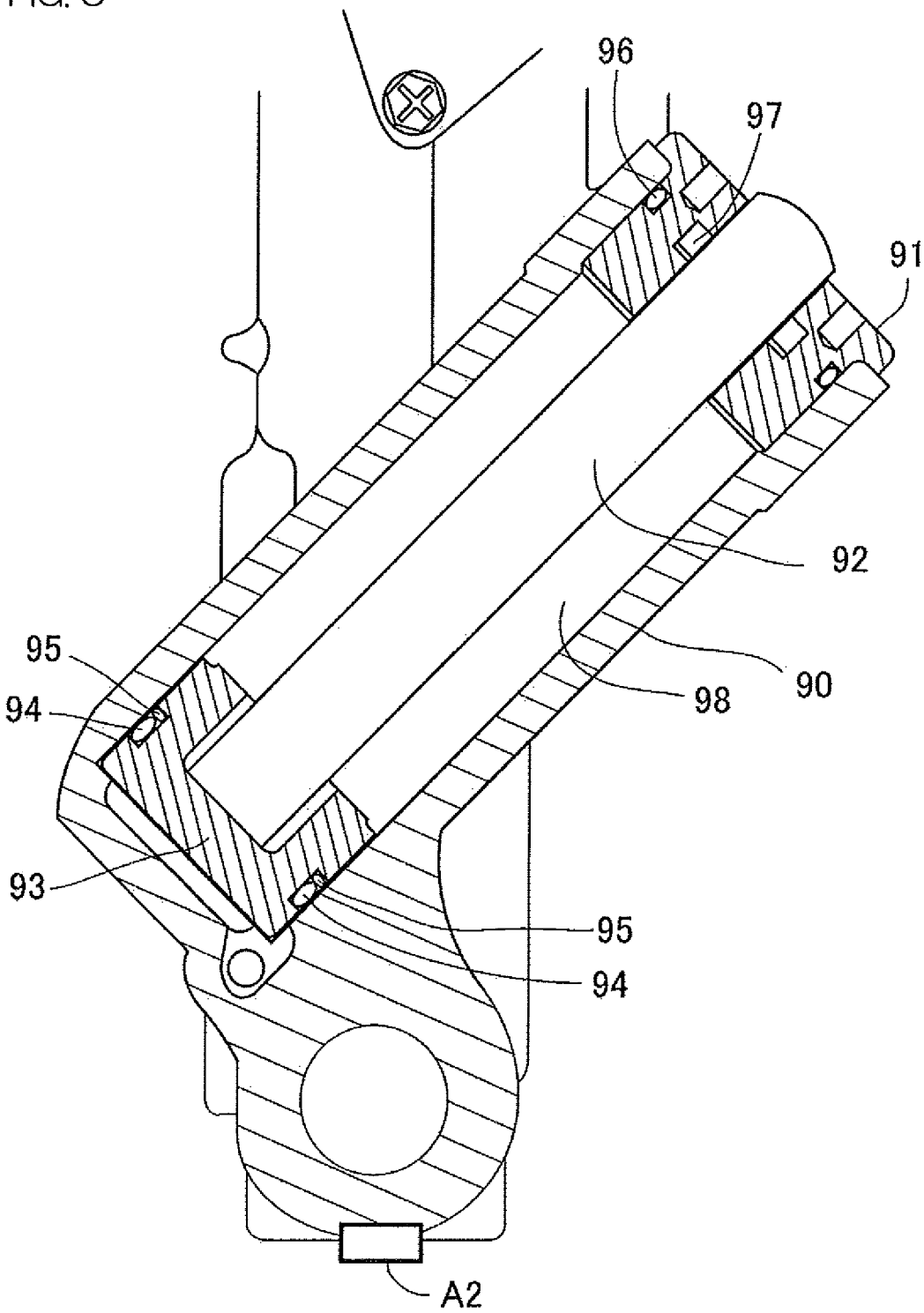
FIG. 5 is a sectional view of a trim mechanism of the tilt cylinder device mentioned above.
Figure 8:
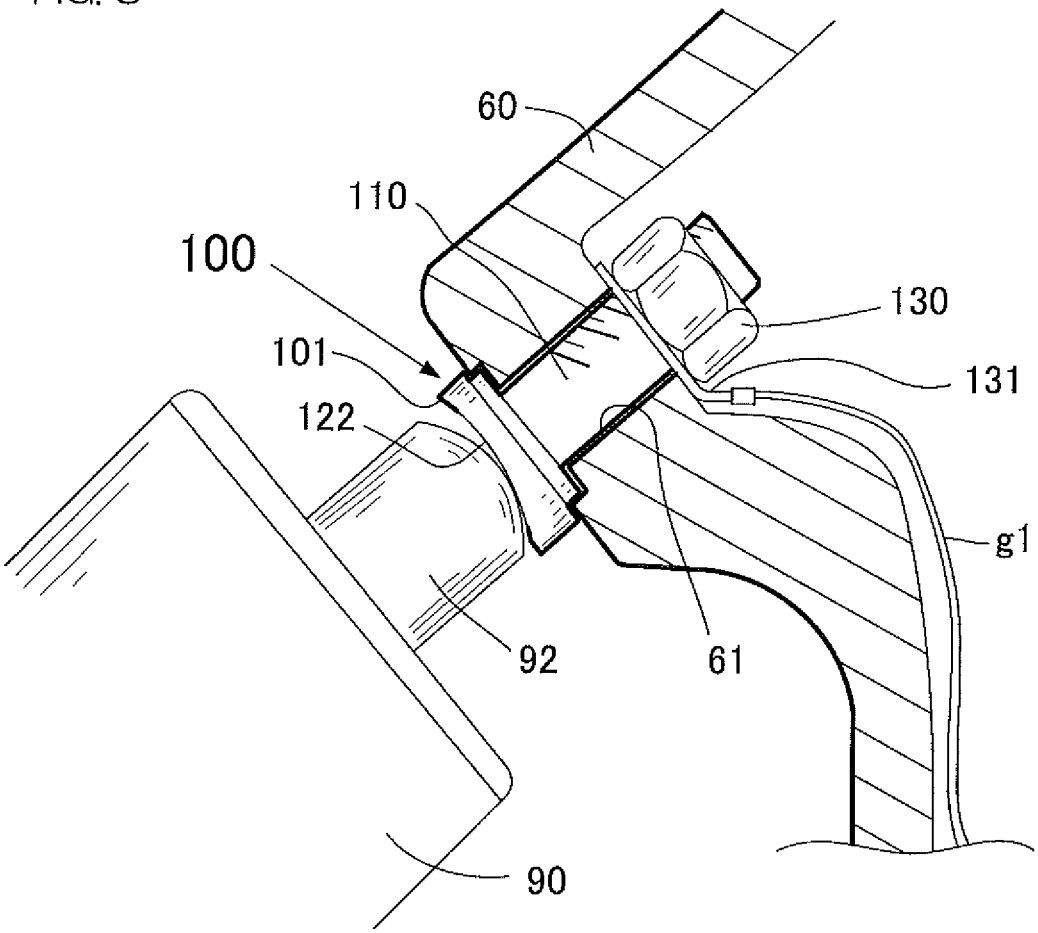
FIG. 8 is a sectional view showing a state in which a trim rod and a thrust receiver are in contact.

The trim cylinder 90 includes a rod guide 91 attached to an upper-end opening portion of the trim cylinder 90. The trim rod 92 is slidably inserted in the rod guide 91. As shown in FIG. 5, the piston 93 of the trim cylinder 90 is fixed to the lower end of the trim rod 92. An upper end portion of the trim rod 92 is, as shown in FIG. 4 and FIG. 8, in a state contactable with the thrust receiver 100 attached to the swivel bracket 60.

As shown in FIG. 3, the tilt cylinder device 70 includes a motor 73 and a reservoir tank 74. The motor 73 and the reservoir tank 74 are respectively fixed to the cylinder block 71 by bolts, for example. A pump (not shown) is provided in a lower portion of the motor 73. When the motor 73 normally rotates or reversely rotates, the pump supplies the hydraulic oil in the reservoir tank 74 to the respective oil chambers of the tilt cylinder 80 and the trim cylinders 90 and 90, and causes the hydraulic oil to be discharged from the respective oil chambers. Accordingly, the tilt rod 84 and the trim rods 92 and 92 operate in directions to project from the respective cylinders 80 and 90, or operate in directions to be retracted into the respective cylinders 80 and 90. As a result, the projection amounts of the respective rods 84 and 92 change.

Next, a tilt operation and a trim operation of the tilt cylinder device 70 will be described.

When the motor 73 is driven, the hydraulic oil is supplied to the lower chambers (lower oil chambers) of the tilt cylinder 80 and the trim cylinders 90 and 90 by the pump (not shown). Accordingly, the tilt rod 84 and the trim rods 92 and 92 simultaneously operate in directions to project from the respective cylinders 80, 90, and 90.

As shown in FIG. 4, a tip portion of the trim rod 92 is in contact with the thrust receiver 100 provided on the swivel bracket 60. Thus, when the trim rod 92 operates in the direction to project from the trim cylinder 90, the swivel bracket 60 and the outboard motor 2 are trimmed up within a predetermined trim range.

On the other hand, when the motor is reversely rotated where the swivel bracket 60 and the outboard motor 2 are within a predetermined trim range, the hydraulic oil is supplied to the upper chambers (upper oil chambers) of the tilt cylinder 80 and the trim cylinders 90 and 90. Accordingly, the tilt rod 84 and the trim rods 92 and 92 simultaneously operate in directions to be retracted into the respective cylinders 80, 90, and 90. Thus, the swivel bracket 60 and the outboard motor 2 trim down with the tip portion of the trim rod 92 being in contact with the thrust receiver 100 of the swivel bracket 60.

By causing the swivel bracket 60 and the outboard motor 2 to trim up or trim down within a predetermined trim range, the trim angle of the outboard motor 2 is adjusted to adjust the running posture of the vessel 3.

When the motor 73 is further normally rotated in a state of maximum projection of the trim rods 92 and 92, that is, in a full trim-up state, only the tilt rod 84 further projects. The tilt rod 84 tilts up the swivel bracket 60 to a full tilt-up position within a tilt range larger than the trim range. Accordingly, the outboard motor 2 attached to the swivel bracket 60 is located above a water surface.

On the other hand, when the motor 73 is reversely rotated in a state in which the outboard motor 2 is located at the full tilt-up position, that is, in a full tilt-up state, the tilt rod 84 is retracted into the tilt cylinder 80. The swivel bracket 60 tilts down accordingly. In the process of this tilt-down, the trim rod 92 contacts the thrust receiver 100 of the swivel bracket 60. Thereafter, the outboard motor 2 attached to the swivel bracket 60 enters a trim range. By controlling the rotation of the motor 73 within the trim range, the trim angle is adjusted.

The trim rod 92 of the trim cylinder 90 is exposed to seawater or the like during use of the outboard motor 2. Moreover, as described below, the trim rod 92 is in a state insulated from the trim cylinder 90 and the rod guide 91. Thus, when the trim rod 92 is exposed to seawater or the like, a potential difference occurs between the trim rod 92 and structural members around the trim rod 92, and eventually, the trim rod may be electrolytically corroded. It is therefore necessary to prevent electrolytic corrosion of the trim rod 92.

Moreover, for the trim rod 92, which receives a thrust of the outboard motor 2 from the thrust receiver 100, some degree of strength is thus required. The trim rod 92 includes a rod member made of, for example, a stainless steel such as SUS630 (JIS: Japanese Industrial Standards), and the outer surface of the trim rod 92 is chromium-plated. The strength is accordingly secured while an improvement in corrosion resistance is achieved. On the other hand, the trim cylinder 90 is made of an aluminum alloy. The outer surface of the trim cylinder 90 is alumite-treated. Accordingly, the corrosion resistance of the trim cylinder 90 is enhanced. The trim rod 92 and the trim cylinder 90 both thus have corrosion resistance.

As shown in FIG. 5, the trim cylinder 90 includes an iron piston 93 fixed to the lower end of the trim rod 92 and a rubber O-ring 94 and a resin backup ring 95 disposed around the piston 93. The piston 93 is disposed in the cylinder tube of the trim cylinder 90 filled with a hydraulic oil.

As shown in FIG. 5, the trim cylinder 90 further includes a rod guide 91 fixed to the upper end of the cylinder tube of the trim cylinder 90, a rubber O-ring 96 disposed between the rod guide 91 and the trim cylinder 90 (cylinder tube), and an oil seal 97 disposed between the trim rod 92 and the rod guide 91. The rod guide 91 is made of an aluminum alloy, and the outer surface of the rod guide 91 is alumite-treated.

As shown in FIG. 4 and FIG. 8, during use of the outboard motor 2, the trim rod 92 is basically in contact with the thrust receiver 100 of the swivel bracket 60. As described below, the thrust receiver 100 includes a conducting portion 122 that is grounded. The conducting portion 122 is provided at a portion of the thrust receiver 100 with which the trim rod 92 comes into contact. Accordingly, the trim rod 92 is grounded via the thrust receiver 100.

Figure 6:
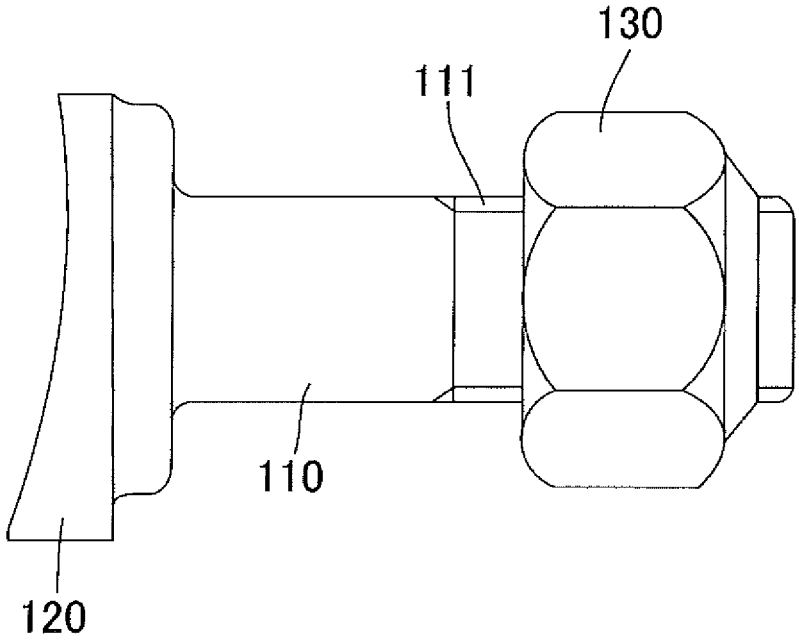
FIG. 6 is a side view of a thrust receiver to be attached to a swivel bracket.
Figure 7:
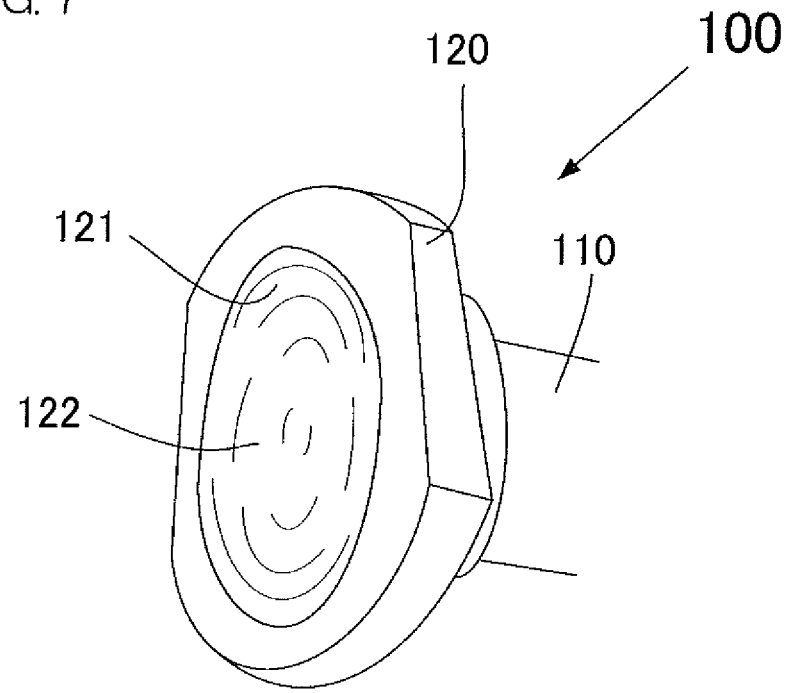
FIG. 7 is a perspective view of a head portion of the thrust receiver mentioned above.

The thrust receiver 100 according to the present preferred embodiment of the present invention is, as shown in FIG. 6 to FIG. 8, a single unitary monolithic member including a column-shaped trunk portion 110 and a disk-shaped head portion 120 larger in outer diameter than the trunk portion 110. The head portion 120 is joined to one end of the trunk portion 110. The thrust receiver 100 is suitably made of, for example, an iron-based material having electrical conductivity such as a stainless steel, such as SUS304 (JIS).

As shown in FIG. 8, in the state in which the thrust receiver 100 is attached to the swivel bracket 60, a lower-side portion of the head portion 120 has a greater thickness than an upper-side portion of the head portion 120.

As shown in FIG. 8, the head portion 120 of the thrust receiver 100 includes a surface (a trim rod contacting surface) that comes into contact with the trim rod 92. The trim rod contacting surface of the thrust receiver 100 has an arc shape in a side view. Because the trim rod contacting surface has an arc shape in a side view, the trim rod 92 contacts the trim rod contacting surface of the thrust receiver 100 reliably and smoothly in response to a motion of the swivel bracket 60 associated with a trim angle adjustment.

As shown in FIG. 7, the outer surface of the head portion 120 of the thrust receiver 100 includes a concave trim rod receiving portion 121 that is recessed in a conical shape. The trim rod 92 contacts at least a portion of the trim rod receiving portion 121. That is, the trim rod receiving portion 121 includes the conducting portion 122 that the trim rod 92 actually contacts.

The thrust receiver 100 is preferably fixed to the swivel bracket 60 in an electrically insulated state. This is to prevent the occurrence of a potential difference caused by a difference in the metal material of the thrust receiver 100 and the swivel bracket 60, and thus prevent the occurrence of electrolytic corrosion.

Moreover, the entire outer surface of the thrust receiver 100 excluding the trim rod receiving portion 121 (a portion of the outer surface of the thrust receiver 100) is preferably covered by an insulating layer 101 such as a paint film. For example, the insulating layer 101 may be formed by spraying coating material to the entirety of the thrust receiver 100 excluding the trim rod receiving portion 121 in a state in which the trim rod receiving portion 121 is masked. Thick lines shown in FIG. 8 indicate insulating layers covering the outer surface of the thrust receiver 100 and the outer surface of the swivel bracket 60.

The conducting portion 122 of the trim rod receiving portion 121 is a site that the tip of the trim rod 92 contacts to be electrically connected with the trim rod 92 during use of the outboard motor 2. Thus, it is desirable not to provide an insulating film in advance on the trim rod receiving portion 121, in particular, the conducting portion 122. However, as described above, the tip of the trim rod 92 contacts the trim rod receiving portion 121 so as to be rubbed against the trim rod receiving portion 121 with a strong pressing force associated with a thrust of the outboard motor 2. Thus, even if there is some sort of film on the outer surface of the conducting portion 122, the film is peeled and removed by use of the outboard motor 2 and with the adjustment of the trim angle. Thus, a film that can be easily peeled by use of the outboard motor may be provided on the outer surface of the conducting portion 122.

The thrust receiver 100 is exposed to outside air, and is wet with seawater or the like during use of the outboard motor 2.

Therefore, when the conducting portion 122 is not covered with a film, the conducting portion 122 may be oxidized or foreign matter may adhere thereto. There is therefore a concern that the electrical connection status between the conducting portion 122 of the thrust receiver 100 and the trim rod 92 deteriorates over time. However, in the present preferred embodiment of the present invention, such a problem is naturally solved by structural features.

That is, during use of the outboard motor 2, the trim rod 92 receives a thrust of the outboard motor 2 to be pressed against the thrust receiver 100 by a strong force. Moreover, in the case of a projecting operation or a retracting operation of the trim rod 92 with respect to the trim cylinder 90 performed for a trim angle adjustment, the swivel bracket 60 rotates about the tilt shaft 51. A tip portion of the trim rod 92 is therefore rubbed against the thrust receiver 100 while contacting the same.

Thus, even if there is an oxide film on the outer surface of the thrust receiver 100 or there is foreign matter adhering to the outer surface of the thrust receiver 100, for the trim rod contacting surface of the thrust receiver 100 that the trim rod 92 contacts, an electrical connection is reliably secured by contact of the trim rod 92 and the thrust receiver 100. Thus, periodic maintenance by a user to maintain the feature and state of the conducting portion 122 is unnecessary.

As shown in FIG. 8, the trunk portion 110 of the thrust receiver 100 is inserted in a thrust receiver attaching hole 61 (through-hole) provided in the swivel bracket 60. As can be understood by referring to both FIG. 6 and FIG. 8, the nut 130 is, in this inserted state, attached to a male screw portion 111 provided at the other end portion of the trunk portion 110. Accordingly, the thrust receiver 100 is fixed by tightening it to the swivel bracket 60.

By screwing the nut 130 onto the male screw portion 111 provided at the trunk portion 110 of the thrust receiver 100, the thrust receiver 100 and the nut 130 are electrically connected. In addition, even when there is some sort of film on the outer surface of the male screw portion 111, the film is scraped away by screwing the nut 130 onto the male screw portion 111. Thus, there may be a film on the outer surface of the male screw portion 111 as long as the film can be easily peeled when the nut 130 is screwed onto the male screw portion 111. Electrical conduction of the thrust receiver 100 and the nut 130 is accordingly secured.

As shown in FIG. 8, a conductive washer 131 is disposed between the nut 130 and the swivel bracket 60. In this state, the conductive washer 131 is electrically connected with the nut 130. A first end portion (upper end portion) of a ground wire g1 is connected to the conductive washer 131. A second end portion (lower end portion) of the ground wire g1 is, as shown in FIG. 4, connected to a ground wire attaching portion provided inside the upper casing 30 of the outboard motor 2. In addition, the upper casing 30 is, as described below, electrically connected with an anode A1 attached to the outboard motor 2. Thus, the trim rod 92 is grounded to the anode A1 via the thrust receiver 100, the conductive washer 131, the ground wire g1, and the upper casing 30.

Moreover, as shown in FIG. 4, a lower portion of the swivel bracket 60 is also connected, via a ground wire g2, to the ground wire attaching portion of the upper casing 30 of the outboard motor 2 together with the ground wire g1. Further, a lower end portion of the tilt cylinder 80 and a lower end portion of the trim cylinder 90 are also connected to an anode A2, which is included in the bottom-portion coupling member 55 disposed at the lower end portion of the clamp bracket 50, via ground wires g3 and g4. All of the respective members of the suspension device 1 for the outboard motor are thus grounded, and prevented from electrolytic corrosion.

Figure 9:
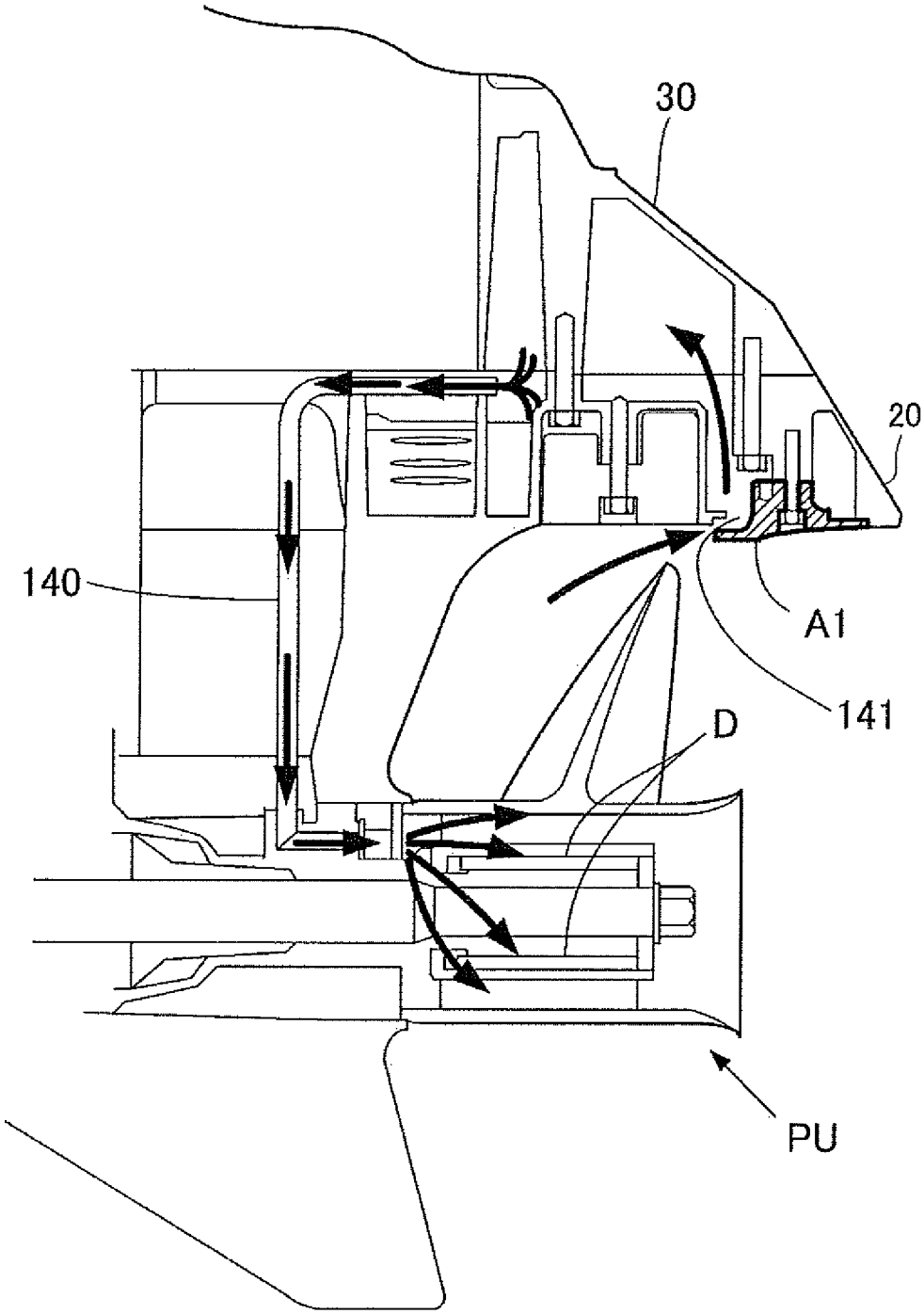
FIG. 9 is a partial sectional view showing a structure for which a sacrificial anode member (anode) is disposed in a cooling water passage of a propeller damper of a propeller unit.

In addition, as shown in FIG. 9, the anode A1 defining and serving as a sacrificial anode member is attached to a lower surface of the lower casing 20 of the outboard motor 2 close to the propeller unit PU. The anode A1 is located under the water surface during use of the outboard motor 2, and is grounded. In the present preferred embodiment of the present invention, a cooling water passage 140 is provided to cool a propeller damper D of the propeller unit PU. As shown in FIG. 9, the anode A1 is attached to the lower casing 20 around a cooling water inlet 141 of the cooling water passage 140. The anode A1 defines the cooling water inlet 141 together with the lower casing 20.

In the preferred embodiments of the present invention described above, the thrust receiver 100 preferably is connected to the anode A1 via the ground wire g1, the upper casing 30, and the lower casing 20. The trim rod 92 is accordingly grounded. However, the present invention is not limited thereto. The thrust receiver 100 may be electrically connected to a structural member of the tilt cylinder device 70 and/or a structural member of the outboard motor 2. The thrust receiver 100 may be electrically connected to the anode A1 and/or the anode A2 via these structural members.

As described above, the suspension device 1 includes the clamp bracket 50 to be mounted on the stern T of the vessel 3 and the swivel bracket 60 coupled to the clamp bracket 50 via the tilt shaft 51.

The suspension device 1 includes the trim cylinder 90 coupled to the clamp bracket 50 and the trim rod 92 that is projectable and retractable from the trim cylinder 90.

The suspension device 1 includes the trim mechanism that adjusts the trim angle of the outboard motor 2 by rotating the swivel bracket 60 about the tilt shaft 51 and the thrust receiver 100 that is attached to the swivel bracket 60 to receive a load from the trim rod 92.

The thrust receiver 100 includes the grounded conducting portion 122. The tip of the trim rod 92 contacts the conducting portion 122. Thus, the trim rod 92 is, by contact of the conducting portion 122 with the trim rod 92, made electrically conductive with the conducting portion 122. Accordingly, the trim rod 92 is grounded via the conducting portion 122.

During use of the outboard motor 2, the trim rod 92 is reliably maintained in a state of being in electrical contact with the thrust receiver 100 as a result of receiving a large load from the thrust receiver 100 due to a thrust of the outboard motor 2. Thus, the trim rod 92 is grounded via the thrust receiver 100. Because the trim rod 92 is reliably grounded during use of the outboard motor 2, which is a situation where the trim rod 92 is most likely to be electrolytically corroded, electrolytic corrosion of the trim rod 92 is effectively prevented. Moreover, because it suffices only to provide the conducting portion 122 in the thrust receiver 100 and ground the thrust receiver 100, the trim rod 92, which has conventionally been difficult to ground, is easily grounded to be protected from electrolytic corrosion without greatly changing the conventional structure.

Moreover, because the trim rod 92 and the thrust receiver 100 are both made of a conductive material, electrical conduction of both is reliably maintained. Moreover, even if there is an oxide film or some sort of other film on the conducting portion 122 of the thrust receiver 100, because the tip portion of the trim rod 92 is strongly pressed against the thrust receiver 100 by a thrust of the outboard motor 2 and rubbed against the thrust receiver 100 in the course of using the outboard motor 2, electrical conduction is secured. Thus, maintenance by a user for the outer surface of the conducting portion 122 of the thrust receiver 100 is unnecessary.

Moreover, because the thrust receiver 100 is connected via the ground wire g1 to the lower casing 20 and therefore to the anode A1, the trim rod 92 is reliably grounded.

The terms and expressions which have been used herein are used as terms of description and not of limitation, and there is no intent of excluding any equivalents of the features shown and described, but it should be recognized that various modifications are possible within the scope of the invention claimed.

The present invention may be embodied in many different forms. The present disclosure should be considered as providing examples of the principles of the present invention. Those examples are described herein with the understanding of not intending to limit the present invention to preferred embodiments described herein and/or illustrated herein.

While illustrative preferred embodiments of the present invention have been described herein, the present invention is not limited to the various preferred embodiments described herein, but includes any and all preferred embodiments having equivalent elements, modifications, omissions, combinations (e.g., of aspects across various preferred embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to."

The present application corresponds to Japanese Patent Application No. 2013-004701 filed on Jan. 15, 2013 in the Japan Patent Office, and the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A suspension device for an outboard motor, the suspension device comprising:

a clamp bracket to be mounted on a vessel;

a swivel bracket coupled to the clamp bracket via a horizontal shaft, and to be attached to the outboard motor;

a trim mechanism that includes a trim cylinder coupled to the clamp bracket and a trim rod extending from the trim cylinder, and that adjusts a trim angle of the outboard motor by rotating the swivel bracket about the horizontal shaft such that an attaching angle of the swivel bracket with respect to the clamp bracket changes; and a thrust receiver attached to the swivel bracket to receive a load from the trim rod, the thrust receiver being grounded, the thrust receiver including a conducting portion in contact with the trim rod, and the thrust receiver being arranged to ground the trim rod by contact of the conducting portion with the trim rod.

2. The suspension device for an outboard motor according to claim 1, wherein the trim rod and the thrust receiver are made of conductive materials.

3. The suspension device for an outboard motor according to claim 1, wherein the thrust receiver is grounded by a ground wire connected to the thrust receiver.

4. The suspension device for an outboard motor according to claim 3, wherein the ground wire is connected to any of the clamp bracket, the swivel bracket, and the outboard motor.

5. The suspension device for an outboard motor according to claim 3, wherein the ground wire is connected to a sacrificial anode member attached to any of the clamp bracket, the swivel bracket, and the outboard motor.

6. The suspension device for an outboard motor according to claim 1, wherein the swivel bracket includes a through-hole into which a trunk portion of the thrust receiver is fitted; and the thrust receiver is fixed to the swivel bracket with the trunk portion of the thrust receiver fitted into the through-hole.

7. The suspension device for an outboard motor according to claim 1, wherein the thrust receiver includes a head portion in contact with the trim rod and a trunk portion coupled to the head portion.

8. The suspension device for an outboard motor according to claim 7, wherein the head portion includes the conducting portion.

9. The suspension device for an outboard motor according to claim 1, wherein an insulating layer is provided on a portion of the thrust receiver excluding the conducting portion.

10. The suspension device for an outboard motor according to claim 1, wherein an insulating layer is provided on at least one of a portion of the thrust receiver that the swivel bracket contacts and a portion of the swivel bracket that the thrust receiver contacts.

11. The suspension device for an outboard motor according to claim 1, wherein an insulating layer is provided on a portion of the thrust receiver that contacts the swivel bracket, and the thrust receiver and the swivel bracket are electrically isolated.

12. The suspension device for an outboard motor according to claim 6, wherein the thrust receiver is fixed to the swivel bracket by a nut screwed onto a screw portion of the trunk portion fitted into the through-hole, and a ground wire electrically contacts the nut.

13. The suspension device for an outboard motor according to claim 6, wherein the thrust receiver is fixed to the swivel bracket by a nut screwed onto a screw portion of the trunk portion fitted into the through-hole, and a ground wire is connected to a conductive washer disposed between the swivel bracket and the nut.

14. The suspension device for an outboard motor according to claim 13, wherein the ground wire is connected to any of the clamp bracket, the swivel bracket, and the outboard motor.

15. The suspension device for an outboard motor according to claim 13, wherein the ground wire is directly or indirectly connected to a sacrificial anode member attached to any of the clamp bracket, the swivel bracket, and the outboard motor.

16. The suspension device for an outboard motor according to claim 1, further comprising a tilt mechanism that rotates the swivel bracket about the horizontal shaft.

17. The suspension device for an outboard motor according to claim 1, wherein the trim mechanism includes two trim cylinders and two trim rods extending from the two trim cylinders, respectively; and the thrust receiver includes two thrust receivers that contact the two trim rods, respectively.

18. The suspension device for an outboard motor according to claim 17, further comprising a tilt mechanism that rotates the swivel bracket about the horizontal shaft; and the tilt mechanism is disposed between the two trim cylinders.

19. A vessel propulsion apparatus comprising an outboard motor and the suspension device according to claim 1.

20. A vessel comprising the vessel propulsion apparatus according to claim 19.

* * * * *